US009820506B2

(12) United States Patent
Rasouli et al.

(10) Patent No.: US 9,820,506 B2
(45) Date of Patent: Nov. 21, 2017

(54) SMOKING ARTICLE MOUTHPIECE INCLUDING AEROGEL

(71) Applicant: Philip Morris Products S.A., Neuchatel (CH)

(72) Inventors: Firooz Rasouli, Midlothian, VA (US); Gianluca Sechi, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 479 days.

(21) Appl. No.: 14/398,045

(22) PCT Filed: Mar. 15, 2013

(86) PCT No.: PCT/IB2013/052096
§ 371 (c)(1),
(2) Date: Oct. 30, 2014

(87) PCT Pub. No.: WO2013/164705
PCT Pub. Date: Nov. 7, 2013

(65) Prior Publication Data

US 2015/0128963 A1 May 14, 2015

Related U.S. Application Data

(60) Provisional application No. 61/640,235, filed on Apr. 30, 2012.

(30) Foreign Application Priority Data

Apr. 30, 2012 (EP) ..... 12166201

(51) Int. Cl.
*A24D 3/06* (2006.01)
*A24D 3/14* (2006.01)
(Continued)

(52) U.S. Cl.
CPC ..... *A24D 3/066* (2013.01); *A24D 3/061* (2013.01); *A24D 3/067* (2013.01); *A24D 3/14* (2013.01); *A24D 3/16* (2013.01); *A24D 3/18* (2013.01)

(58) Field of Classification Search
USPC ..... 131/88, 331, 332, 341, 342, 344, 345
See application file for complete search history.

(56) References Cited

U.S. PATENT DOCUMENTS 4,033,361 A * 7/1977 Horsewell ..... A24D 3/12 131/334
2007/0204870 A1 9/2007 Deevi et al.
(Continued)

FOREIGN PATENT DOCUMENTS

CN 201839795 U 5/2011
CN 102247012 A 11/2011
(Continued)

OTHER PUBLICATIONS

International Preliminary Report on Patentability for PCT/IB2013/052096, dated Nov. 13, 2014 from the International Bureau of WIPO; 6 pgs.
(Continued)

*Primary Examiner* — Dennis Cordray
(74) *Attorney, Agent, or Firm* — Mueting, Raasch & Gebhardt, P.A.

(57) ABSTRACT

A smoking article (10) incorporates a mouthpiece (14), the mouthpiece includes an open pore structure converted from an organic gel and a functional material dispersed in the open pore structure, such as aerogel particles (20).

19 Claims, 2 Drawing Sheets

(51) Int. Cl.
*A24D 3/18* (2006.01)
*A24D 3/16* (2006.01)

(56) References Cited

U.S. PATENT DOCUMENTS

| | | | | |
|---|---|---|---|---|
| 2007/0295345 | A1 | 12/2007 | Caraway, Jr. et al. | |
| 2012/0222690 | A1 * | 9/2012 | Branton ..... | A24D 3/067<br>131/332 |

FOREIGN PATENT DOCUMENTS

| | | | |
|---|---|---|---|
| EP | 2401929 | A1 | 4/2012 |
| JP | 2008-528051 | A | 7/2008 |
| WO | WO 2006/082525 | A1 | 8/2006 |
| WO | WO 2010/107375 | | 9/2010 |
| WO | WO 2011/030151 | | 3/2011 |
| WO | WO 2011/030151 | A1 * | 3/2011 |

OTHER PUBLICATIONS

International Search Report and Written Opinion for PCT/IB2013/052096, dated Jul. 18, 2013, 10 pgs.

* cited by examiner

SMOKING ARTICLE MOUTHPIECE INCLUDING AEROGEL

This application is the §371 U.S. National Stage of International Application No. PCT/IB2013/052096, filed 15 Mar. 2013, which claims the benefit of U.S. Provisional Application No. 61/640,235, filed 30 Apr. 2012, and European Application No. 12166201.9, filed 30 Apr. 2012, which are incorporated by reference herein in their entireties.

The present disclosure relates to a smoking article mouthpiece or a mouthpiece filter element that includes a material that is converted from an organic gel to an open pore structure.

Smoking articles typically include portions that are designed to accommodate the flow of air. For example, many conventional cigarettes include a filter element comprising functional materials that capture or convert components of the smoke from the smoking article or release materials into the smoke as smoke is being drawn through the filter. Such functional materials are known and include, for example, sorbents, catalysts and flavorant materials.

In other examples, the smoking article is designed to heat rather than combust tobacco. In yet other examples the smoking article is designed to neither heat nor combust tobacco; rather, it is designed to deliver a component of tobacco by passing air or a functional material, or both air and a functional material, over the tobacco. Such non-combustion smoking articles may also include one or more portions that are designed to accommodate the flow of air. For example, such smoking articles may include portions with flavorants or other functional materials that are designed to be released into the air or smoke stream that is being drawn through the smoking article.

Aerogels are synthetic highly porous material derived from a gel, where the liquid component in the gel has been replaced with a gas. The result is a solid with an open cell structure and low density. Despite their name, aerogels are rigid, dry materials that do not resemble a gel in their physical properties; the name comes from the fact that they are derived from gels. By weight, gels are mostly liquid but behave like solids due to a three-dimensional cross-linked network within the liquid. Gels generally are a dispersion of molecules of a liquid within a solid in which the solid is the continuous phase and the liquid is the dispersed phase.

Aerogels are often friable but are typically structurally strong. In some cases, their impressive load bearing ability can be traced to a dendritic microstructure, in which spherical particles of average size of about 2-5 nanometers are fused together in clusters. These clusters can form a three dimensional highly porous structure of almost fractal chains, in some cases with pores under about 100 nanometers. The average size and density of the pores can be controlled during the manufacturing process.

For simplicity, this application refers to aerogels, but one of ordinary skill in the art would also understand that the mouthpiece could include any open pore structure that is converted from an organic gel, for example xerogels and cryogels as well as, or in place of, aerogels. As such, in many embodiments, an open pore structure that is converted from an organic gel may be substituted for the aerogels used below, or the aerogel may be substituted by a xerogel or cryogel.

It would be desirable to provide a novel smoking article that has a mouthpiece providing a large surface area to capture or convert smoke constituents or to release functional materials into an air stream flowing through the smoking article. Functional materials that provide flavour or capture or convert smoke constituents are able to operate more efficiently as the available surface area of the mouthpiece filter element increases. As the efficiency of these materials increases, a lower amount of these materials can be utilized in the mouthpiece filter element, while maintaining the desired results obtained by the functional material.

It would also be desirable to provide a novel smoking article having physical properties such as firmness being substantially independent of air flow properties such as resistance to draw (RTD) and the amount of contact between the air flow and functional materials.

It would also be desirable to provide a novel smoking article that has a mouthpiece with an organic aerogel that can form or provide structural features of the mouthpiece.

According to the current disclosure, there is provided a smoking article having a mouthpiece that includes an organic aerogel. The organic aerogel forms an open pore structure. Functional materials can be dispersed in the aerogel and the specific functional material and amount of functional material can be selected based on the desired result to be obtained with the functional material. The aerogel can be utilized to provide structural properties of the mouthpiece. The aerogel can be formed as a monolithic or continuous element forming all or a portion of the mouthpiece. In other examples, the aerogel can be incorporated into the mouthpiece or mouthpiece filter element as a plurality of particles dispersed in the mouthpiece or mouthpiece filter element.

Smoking articles according to the present disclosure provide an effective way to design the air flow properties through the mouthpiece while also maintaining the desired physical properties of the smoking article such as shape, strength and firmness. The organic aerogel allows the mouthpiece (such as a mouthpiece filter element) to have a high surface area and increases the efficiency of functional materials that are dispersed within the aerogel. The aerogel can be formed in any shape and can provide structural properties to the mouthpiece.

Smoking articles according to the present disclosure include a mouthpiece including an organic aerogel forming an open pore structure. The aerogel can form the physical structure of the mouthpiece filter element or can be in the form of a plurality of aerogel particles dispersed in a mouthpiece filter element. In many embodiments, the aerogel forms the physical structure of the mouthpiece filter element. The aerogel provides the structural properties that provide the customary firmness found in mouthpieces (such as mouthpiece filter elements).

The term "open pore structure" refers to a structure that includes a network or matrix defining interconnected voids or pores. An aerosol, gas, or vapour can pass through the open pore structure via the interconnected voids or pores of the aerogel. In many embodiments, the voids or pores have an average size of less than 500 micrometers, or less than 250 micrometers, or less than 100 micrometers. The size of the voids or pores can be determined by cutting through a particle or a portion of a monolithic element of the open pore structure and measuring the largest cross-sectional dimension of each of the voids or pores. The average size of the voids or pores is the arithmetic mean of these measurements. This open pore structure allows air or tobacco smoke to flow through the aerogel structure. The pore size of the open pore structure can be chosen to provide a resistance to draw that is similar to a resistance to draw of a conventional smoking article. In many embodiments the mouthpiece or mouthpiece filter including an aerogel or open pore structure has a resistance to draw in a range from about 50 to 120 mm $H_2O$ or from about 60 to 100 mm $H_2O$. Thus the smoking experience for conventional smoking articles described herein may be comparable to conventional smoking articles.

The term "organic aerogel" refers to an aerogel preferably comprising at least about 75% by weight, more preferably at least 90% by weight, even more preferably consisting essentially of, or most preferably consisting of, organic compounds. Organic compounds include any compounds commonly referred to as organic, for example those falling under the IUPAC nomenclature of organic chemistry (commonly referred to as the "Blue Book"). Examples include polymers, sugars, proteins, cellulosic material and the like.

This is in contrast to other materials, such as activated carbon materials, which are generally not considered organic compounds. For example, some materials (including some organic compounds) can be carbonized, pyrolyzed, or otherwise heated in order to create activated carbon structures, but after the material has been activated it would no longer be considered an organic compound. In some cases, the organic aerogel is not carbonized, pyrolyzed, or otherwise heated above 150 degrees C.

In addition, the materials of the aerogel are preferably non-crosslinked in order to maintain an open pore structure.

Aerogels that are useful for mouthpieces or mouthpiece filter elements can have a density of less than about 0.35 $g/cm^3$ or less than about 0.1 $g/cm^3$ or less than about 0.05 $g/cm^3$. These aerogels can have a surface area greater than about 500 $m^2/g$ or greater than about 750 $m^2/g$ or greater than about 1000 $m^2/g$, as determined by mercury intrusion porosimetry. These aerogels can have at least about 50% void space (or gas volume) or at least about 75% void space or at least about 90% void space.

Aerogels that are useful for mouthpiece filter elements can be formed by creating a gel in solution and then removing the liquid to leave the aerogel structure intact. The gel is formed by combining a gelling agent, and a liquid, for example. In many embodiments, the liquid is removed from the gel via supercritical extraction or supercritical drying.

Supercritical extraction or drying is performed by increasing the temperature and pressure of the gel to force the liquid into a supercritical fluid (where its liquid and gaseous phases become indistinguishable). By dropping the pressure the liquid is vaporized and removed, forming an aerogel.

In some embodiments, the gel is placed in a pressure vessel and the pressure vessel is filled with liquid carbon dioxide. The liquid carbon dioxide is essentially a solvent that can displace the liquid (such as water or solvent) in the pores in the gel. The gel is soaked in liquid carbon dioxide over the course of several days. The carbon dioxide replaces the liquid in the pores of the gel. Then the carbon dioxide is heated past its critical temperature (31 degrees centigrade) and pressure (73 atm). The vessel is then isothermally depressurized, resulting in the aerogel.

The term "gelling agent" refers to a material that, when mixed with solvent liquid (at appropriate proportions and processing conditions), converts the and liquid from a flowable liquid to a moldable solid, semi-solid or gel. Gels include a solid three-dimensional network that spans the volume of liquid medium and entangles it though surface tension effects.

Organic aerogels include natural or synthetic polymers, cellulosic material, sugars, proteins and the like. In many embodiments the organic gelling agent is synthetic or natural polymer such as cellulose acetate, polystyrene, polylactic acid, and the like. In some embodiments the organic gelling agent is paper or cellulosic material. In some embodiments the organic gelling agent is a polysaccharide or protein, or combinations of one or more polysaccharides and one or more proteins. Polysaccharides can include starches, vegetable gums, agar, carrageenan or pectins, for example. Gelling agents can also include alginates or alginate salts such as, alginic acid, sodium alginate, potassium alginate, ammonium alginate or calcium alginate, for example. Gelling agents can include gelatin, for example. Preferred organic gelling agents include pectin, sodium alginate, calcium alginate, gum arabic and collagens, such as gelatin.

A liquid can be combined with the gelling agent to form the gel and resulting aerogel. Liquids can include solvents or water, or solvents and water. Useful solvents include ethanol, methanol, acetone, methyl ethyl ketone, 2-propanol, carbon dioxide, hexane, and toluene, for example.

The aerogel can be formed in any useful or desired shape. The gel can be molded into any useful form and then the liquid is removed resulting in a similarly shaped aerogel element. In many embodiments, the aerogel element is a monolithic or continuous element forming at least a portion of the mouthpiece or mouthpiece filter element of a smoking article. In this manner, the aerogel provides structural properties to the mouthpiece or mouthpiece filter element and allows the mouthpiece to possess a customary firmness, as compared to conventional mouthpiece or mouthpiece filter element. In many embodiments the aerogel element is a monolithic element forming a mouthpiece filter element of a cigarette.

A plurality of open channels can extend thought a length of the continuous aerogel element. These open channels can be formed via any useful method. In many embodiments, these open channels are formed during a molding process. The gel can be disposed in the cavity of the molding element defined by side surfaces and a bottom surface. In some embodiments, a plurality of elongated channel forming members are fixed to the bottom surface and extend through a length of the aerogel. In other embodiments, the plurality of elongated channel forming members are fixed to a support element that is movable relative to the molding element. The elongated channel forming members define a void space or channel through the aerogel once the aerogel is formed and removed from the cavity of the molding element.

The elongated channel forming members can have any useful diameter such as, about 25 micrometers or less, or about 15 micrometers or less. Any useful number of channel forming members can be disposed in the cavity of the molding element such as at least about 10 or at least about 20. The channel forming members can extend along the entire length of the aerogel or at least about 90% or at least about 75% of the length of the aerogel.

In some embodiment, the aerogel is formed as a plurality of particles having any useful size. In these embodiments the aerogel particles have an average size of at least about 50 micrometers, or at least about 100 micrometers, or at least about 250 micrometers. The aerogel particles have an average size of less than least about 5000 micrometers, or less than least about 1000 micrometers, or less than least about 500 micrometers. For the purposes of the present invention, the "particle size" is considered to be the largest cross sectional dimension of the individual particles within the particulate material. The "average" particle size refers to the arithmetic mean particle size for the particles. The particle size distribution for a sample of particulate material may be determined using a known sieve test.

The plurality of aerogel particles can be dispersed in the mouthpiece or mouthpiece filter element, as desired. In many embodiments the aerogel is dispersed in a cellulose acetate tow of the mouthpiece filter element. The aerogel particles can be dispersed in the mouthpiece or mouthpiece filter element (for example, cellulose acetate tow) at any desired weight %. In some embodiments the aerogel particles are dispersed in the mouthpiece or mouthpiece filter element (for example, cellulose acetate tow) in an amount of at least about 1 wt % or at least about 5 wt % or at least 10 wt %. In some embodiments, the aerogel particles are dispersed in the mouthpiece or mouthpiece filter element in an amount of less than about 90 wt %.

The organic aerogel can include a functional material. The functional material can be combined with the gelling agent and liquid to form the gel and the resulting aerogel. The functional material can be dispersed within the open pore structure of the aerogel. The aerogel provides a high surface area to improve the efficiency of the functional material. Thus, a lower amount of functional material can be utilized with the open pore structure of the aerogel, as compared to conventional smoking articles. The functional material can be incorporated into the aerogel structure, essentially "locking" the functional material into the aerogel matrix or structure. Functional material can include materials that are released into the gas or smoke passing though the aerogel. Functional material can include material that captures or converts smoke constituents. The functional material can be physically bound within the aerogel. In preferred embodiments, the functional material is not chemically or covalently bound to the aerogel.

Material that captures smoke constituents includes sorbents such as activated carbon, coated carbon, active aluminium, zeolites, sepiolites, molecular sieves, and silica gel, for example. Material that captures smoke constituents includes ion exchange materials such as single amino acids, amino functional materials, and polyelectrolytes, for example. In many embodiments activated carbon is dispersed within the aerogel. In some embodiments, the particle size of the material that captures or converts smoke constituents may be measured using a standard mesh test. For example, at least about 90% by weight of the material may have a particle size between ASTM 20 and ASTM 70.

In other embodiments, since the functional material is "locked" or physically bound in the aerogel structure, smaller sized functional material can be utilized. For example, more than about 10% by weight of the particles may be smaller than ASTM 70, or more than about 25% by weight of the particles may be smaller than ASTM 70. The material, such as activated carbon, can be present in the aerogel structure and incorporated into the smoking article mouthpiece in an amount of about 40 to 180 mg/smoking article or from about 60 to 100 mg/smoking article.

Material that converts smoke constituents includes catalysts such as manganese, chromium, iron, cobalt, nickel, copper, zirconium, tin, zinc, tungsten, titanium, molybdenum, vanadium materials, titania, ceria and gold or gold on titania and nanostructures such as carbon nanotubes for example.

Functional materials that are released into the gas or smoke passing through the aerogel or mouthpiece of the smoking article include flavourant material. Flavourant material includes tobacco. Flavourant material includes liquid flavourant or particles of a sorbent or cellulosic material impregnated with liquid flavourant or particulate material such as herbaceous material. Flavourants include, but are not limited to, natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool. In addition, flavourant includes an essential oil, or a mixture of one or more essential oils. An "essential oil" is an oil having the characteristic odour and flavour of the plant from which it is obtained. Suitable essential oils include, but are not limited to, peppermint oil and spearmint oil. In many embodiments the flavourant comprises menthol, Eugenol, or a combination of menthol and Eugenol.

The term "herbaceous material" is used to denote material from an herbaceous plant. A "herbaceous plant" is an aromatic plant, the leaves or other parts of which are used for medicinal, culinary or aromatic purposes and are capable of releasing flavour into smoke produced by a smoking article. Herbaceous material includes herb leaf or other herbaceous material from herbaceous plants including, but not limited to, mints, such as peppermint and spearmint, lemon balm, basil, cinnamon, lemon basil, chive, coriander, lavender, sage, tea, thyme and carvi. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens* variegata.

The thermally insulating property of aerogel allows for the incorporation of materials that are exothermic such as catalysts in the mouthpiece or mouthpiece filter element to maintain the temperature of the mouthpiece or mouthpiece filter element at a comfortable level for a user.

The term "smoke" or "tobacco smoke" refers to the aerosol or vapor given off as a tobacco material undergoes combustion, pyrolysis, heating or chemical reaction.

The term "mouthpiece" refers to the portion of the smoking article that is configured to fit inside or adjacent to the smoker's mouth and contact the lips. The mouthpiece, for example, can refer to the filter portion of a conventional smoking article, such as the 30 mm mouth end portion of the smoking article, or the 20 mm mouth end portion of the smoking article.

In many embodiments the overall length of smoking article is between about 70 mm and about 128 mm, or about 84 mm. The external diameter of smoking article can be between about 5 mm and about 8.5 mm, or between about 5 mm and about 7.1 mm for slim sized smoking articles or between about 7.1 mm and about 8.5 mm for regular sized smoking articles.

The resistance to draw (RTD) of the smoking articles of the present disclosure can vary based on the incorporation and structure of the aerogel in the mouthpiece or mouthpiece filter element. In many embodiments the RTD of the smoking article is between about 50 and about 140 mm $H_2O$, or between about 60 and about 120 mm $H_2O$. The RTD of a smoking article refers to the static pressure difference between the two ends of the specimen when it is traversed by an air flow under steady conditions in which the volumetric flow is 17.5 milliliters per second at the output end. The RTD of a specimen can be measured using the method set out in ISO Standard 6565:2002.

Smoking articles according to the present invention may be packaged in containers, for example in soft packs or hinge-lid packs, with an inner liner coated with one or more flavourants.

Any of the above materials may be used in mouthpieces or mouthpiece filters of conventional combustible smoking articles such as cigarettes, or may be used in mouthpieces or mouthpiece filters of non-combustible smoking articles, for example smoking articles that are configured to deliver a component of tobacco using heat, air flow or a chemical reaction.

The disclosure will be further described, by way of example only, with reference to the accompanying drawings, in which.

Figure 1:
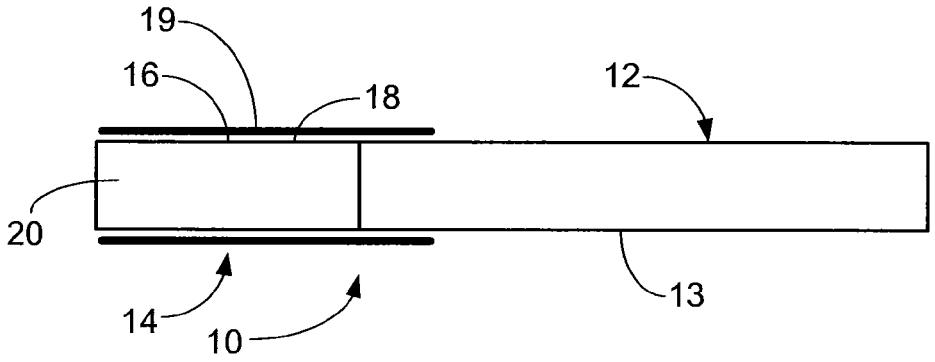
FIG. 1 shows a schematic cross section view of a smoking article according to the present disclosure having a mouthpiece filter element formed of aerogel.
Figure 2:
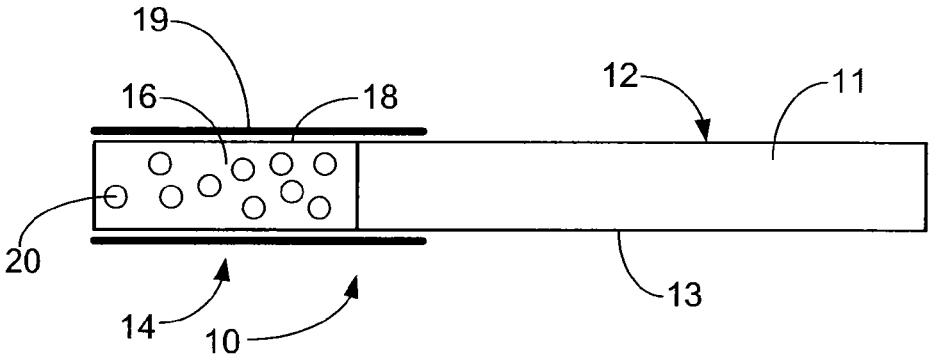
FIG. 2 shows a schematic cross section view of a smoking article according to the present disclosure having a mouthpiece filter element formed of a plurality of aerogel particles dispersed in filter tow.

The smoking article 10 shown in FIG. 1 and FIG. 2 includes a tobacco substrate or tobacco rod 12 attached to an axially aligned mouthpiece or mouthpiece filter element 14. The mouthpiece or mouthpiece filter element 14 includes a filtration element 16 that can be formed of aerogel 20 wrapped in plug wrap 18. Tipping paper 19 joins the tobacco rod 12 to the axially aligned filter 14. Cigarette wrapper 13 surrounds the tobacco substrate which includes tobacco cut filler 11.

FIG. 1 illustrates a monolithic aerogel element 20 forming the structure of the mouthpiece filtration element 16. The illustrated monolithic aerogel mouthpiece filtration element 20 in FIG. 1 is a cylindrical element forming the mouthpiece or mouthpiece filter element 14 of the smoking article 10.

FIG. 2 illustrates a plurality of aerogel particles 20 dispersed in the filtration element 16 that can be cellulose acetate tow, for example.

Figure 3:
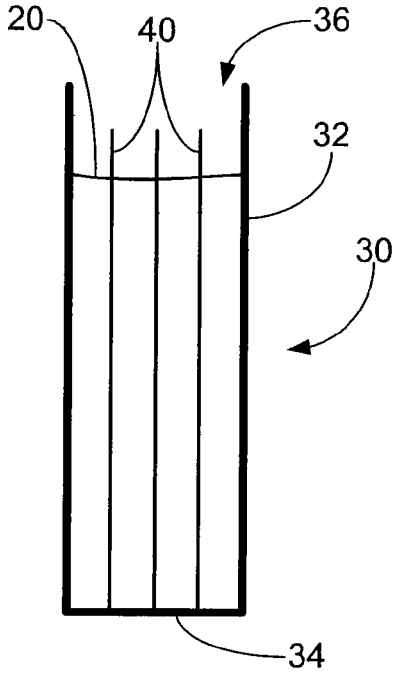
FIG. 3 shows a schematic diagram side view of an molding element.

FIG. 3 shows a schematic diagram side view of an molding element 30 that can be utilized in the formation of the aerogel 20. The gel can be disposed in the cavity 36 of the molding element 30. The cavity 36 is defined by side surfaces 32 and a bottom surface 34. A plurality of elongated channel forming members 40 are fixed to the bottom surface 34 and extend through a length of the aerogel 20. The elongated channel forming members 40 define a void space or channel through the aerogel 20 once the aerogel 20 is formed and removed from the cavity 36 of the molding element 30.

The elongated channel forming members 40 can have any useful diameter such as, about 25 micrometers or less, or about 15 micrometers or less. Any useful number of channel forming members 40 can be disposed in the cavity 36 of the molding element 30 such as at least about 10 or at least about 20. The channel forming members 40 can extend along the entire length of the aerogel 20 or at least about 90% or at least about 75% of the length of the aerogel 20.

Figure 4:
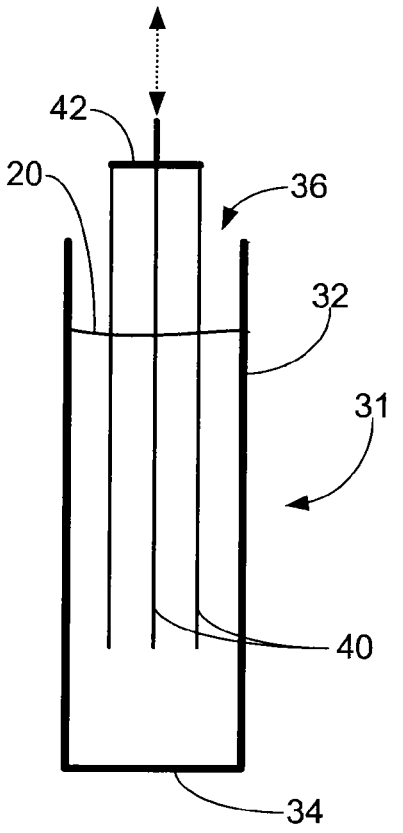
FIG. 4 shows a schematic diagram side view of another molding element.

FIG. 4 shows a schematic diagram side view of another molding element 31. In this embodiment the elongated channel forming members 40 are movable relative to the cavity 36 of the molding element 30. The elongated channel forming members 40 are fixed to a support element 42 that is longitudinally movable relative to the cavity 36 of the molding element 30 along the length of the side surfaces 32 and moving toward and away from the bottom surface 34. The elongated channel forming members 40 extend through a length of the aerogel 20 and are described above. The elongated channel forming members 40 define a void space or channel through the aerogel 20 once the aerogel 20 is formed and removed from both the cavity 36 of the molding element 30 and the elongated channel forming members 40.

The invention claimed is:

1. A smoking article comprising a mouthpiece, the mouthpiece comprising:

non-crosslinked organic aerogel having an open pore structure converted from an organic gel, and a functional material dispersed in the open pore structure.

2. A smoking article according to claim 1 wherein the functional material comprises a material that captures or converts smoke constituents.

3. A smoking article according to claim 1 wherein the functional material comprises a flavourant material.

4. A smoking article according to claim 1 wherein the organic aerogel comprises cellulose acetate.

5. A smoking article according to claim 1 wherein the functional material comprises a sorbent or catalyst.

6. A smoking article according to claim 1 wherein the open pore structure is formed from a polymer comprising polystyrene or polylactic acid or cellulose material.

7. A smoking article according to claim 1 wherein the mouthpiece comprises a continuous aerogel element.

8. A smoking article according to claim 7 further comprising a plurality of open channels that extend through a length of the continuous aerogel element.

9. A smoking article according to claim 1 wherein the mouthpiece comprises a plurality of aerogel particles dispersed in a filtration element.

10. A smoking article according to claim 5 wherein the sorbent comprises activated carbon.

11. A method comprising:

combining a functional material with a gelling agent and solvent to from a gel;

removing the solvent from the gel to form an organic aerogel; and disposing the organic aerogel in a smoking article mouthpiece.

12. A method according to claim 11 further comprising forming a smoking article by combining a tobacco substrate with the smoking article mouthpiece.

13. A method according to claim 11 wherein the functional material comprises a material that captures or converts smoke constituents.

14. A method according to claim 11 further comprising:

disposing the gel in a molding element;

providing a plurality of elongate members through a length of the gel;

forming the organic aerogel in the molding element by removing the solvent from the gel, wherein the organic aerogel comprises a plurality of open channels that extend through a length of the organic aerogel.

15. A smoking article filter element comprising an organic aerogel comprising cellulose acetate.

16. A smoking article filter element according to claim 15 wherein the organic aerogel further comprises a material that captures or converts smoke constituents, wherein the material is dispersed in the organic aerogel.

17. A smoking article filter element according to claim 15 wherein the organic aerogel further comprises a flavourant material dispersed in the organic aerogel.

18. A smoking article filter element according to claim 15 wherein the organic aerogel defines a continuous aerogel filter element that forms at least a portion of the smoking article filter element.

19. A smoking article filter element according to claim 15 wherein the organic aerogel defines a plurality of aerogel particles comprising functional material, the plurality of aerogel particles dispersed in the filter element.

* * * * *